US006250380B1

(12) United States Patent
Strahle et al.

(10) Patent No.: US 6,250,380 B1
(45) Date of Patent: Jun. 26, 2001

(54) HEAT EXCHANGER, ESPECIALLY FOR GASES AND FLUIDS

(75) Inventors: Roland Strahle, Unterensingen; Viktor Brost, Aichtal, both of (DE)

(73) Assignee: Modine Manufacturing Company, Racine, WI (US)

( * ) Notice: Subject to any disclaimer, the term of this patent is extended or adjusted under 35 U.S.C. 154(b) by 0 days.

(21) Appl. No.: 09/415,415

(22) Filed: Oct. 8, 1999

(30) Foreign Application Priority Data

Oct. 9, 1998 (DE) ..... 198 46 518

(51) Int. Cl.[7] ..... F28F 3/12; F28D 9/00
(52) U.S. Cl. ..... 165/167; 165/166
(58) Field of Search ..... 165/166, 167, 165/153

(56) References Cited

U.S. PATENT DOCUMENTS 3,240,268 * 3/1966 Armes ..... 165/167
4,310,960 * 1/1982 Parker ..... 165/166
4,869,317 * 9/1989 Jubb et al. ..... 165/166
5,327,958 * 7/1994 Machara et al. ..... 165/167
5,931,219 * 8/1999 Kull et al. ..... 165/51
5,964,280 * 10/1999 Wehrmann et al. ..... 165/140

FOREIGN PATENT DOCUMENTS

128287 * 12/1900 (DE) ..... 165/166
3832013 3/1990 (DE) .
4307503 9/1994 (DE) .
4307504 9/1994 (DE) .
4407080 9/1994 (DE) .
0 677 715 A1 4/1995 (DE) .

* cited by examiner

*Primary Examiner*—Allen Flanigan
(74) *Attorney, Agent, or Firm*—Wood, Phillips, VanSanten, Clark & Mortimer

(57) ABSTRACT

A gas/liquid heat exchanger includes a stack of abutting, substantially identical plates that are arranged in alternating fashion to define first and second flow channels. End plates are placed on the stack of the aforementioned plates. The core allows straight through flow of gas in the first fluid passageways which may be made relatively large and the use of a cooling liquid flow through the second coolant passageways for cooling the gas in the first coolant passageways.

8 Claims, 7 Drawing Sheets

FIG. 11
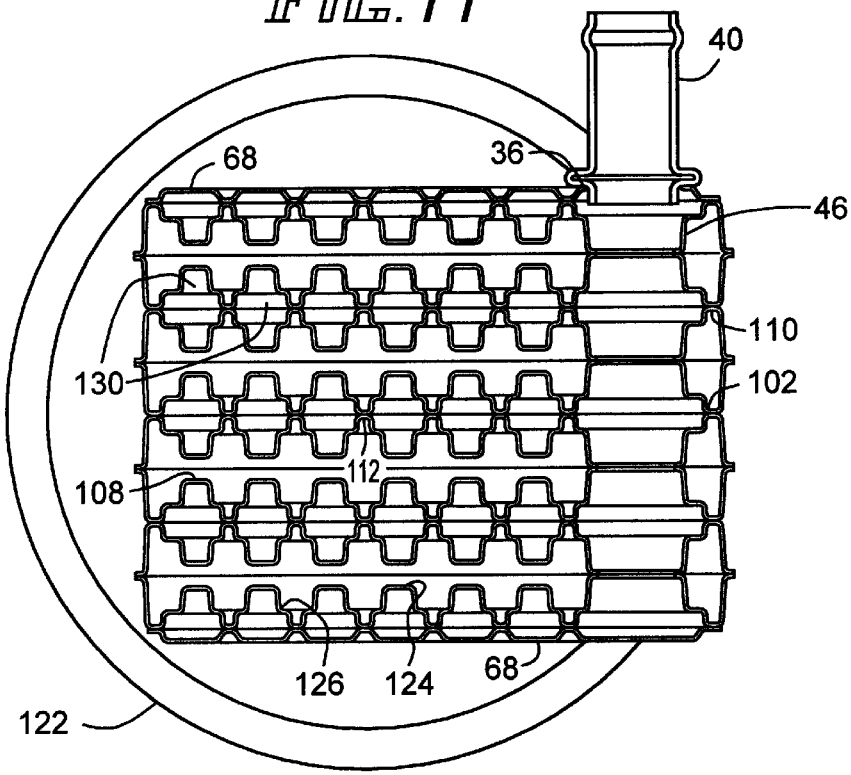
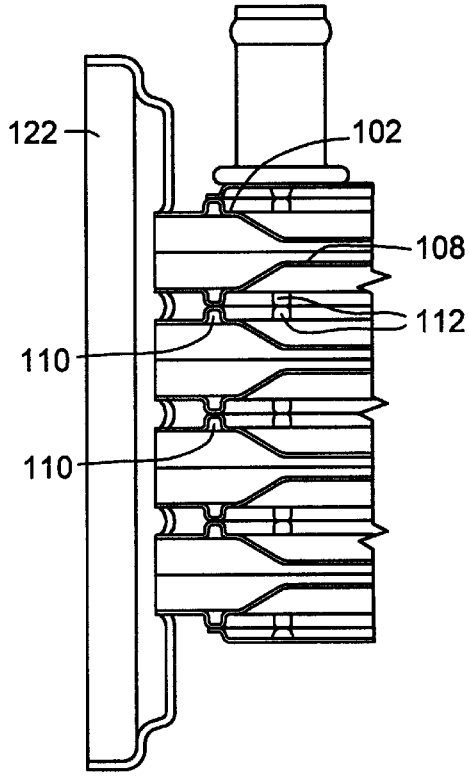
FIG. 12

HEAT EXCHANGER, ESPECIALLY FOR GASES AND FLUIDS

FIELD OF THE INVENTION

This invention relates to heat exchangers, and more particularly, to heat exchangers adapted to exchange heat between a gas and a liquid as, for example, a water cooled charge air cooler or an exhaust gas heat exchanger as are used in vehicles to cool combustion air from a turbo charger or engine exhaust gas.

BACKGROUND OF THE INVENTION

Charge air coolers and exhaust gas heat exchangers are known to increase efficiency of operation of vehicles and/or reduce pollution. One such typical heat exchanger, specifically described as an exhaust gas heat exchanger, is disclosed in EP 677 715 A1 and employs shell like, heat exchanger plates that are employed in a heat exchanger where exhaust gas is cooled with cooling air. The flow channels for the exhaust formed by the shell-like heat exchanger plates are arranged in a pre-arranged spacing with cooling air passed through the spaces between adjacent plates. However, where cooling of the exhaust gas is achieved by a cooling liquid as, for example, engine coolant, then the flow channels for both the coolant and the exhaust gas are formed by means of plates that have rods or spacers between them to form the flow channels and are also enclosed by a housing, which forms the outer wall of the water cooling channels. This design, while effective, is costly to manufacture because a large number of individual parts of different configurations are required.

The present invention is directed to provide such a heat exchanger wherein the number of non-identical parts is minimized and the outer housing dispensed with.

SUMMARY OF THE INVENTION

It is the principal object of the invention to provide a new and improved gas/liquid heat exchanger. More specifically, it is an object of the invention to provide such a heat exchanger that is ideally suited for use as a charge air cooler or an exhaust gas heat exchanger. It is a further object of the invention to provide such a heat exchanger where the number of non-identical parts is minimized and the heat exchanger housing dispensed with.

A preferred embodiment of the invention contemplates a gas/liquid heat exchanger that includes a stack of abutting, substantially identical plates with there being first, second, third, fourth, . . . nth plates where "n" is an even integer of four or more. Each plate is a generally channel-shaped plate having a base with spaced sides and spaced ends extending between the spaced sides. Upstanding legs are located on the base with each leg extending along a corresponding side and being of equal height. Each leg terminates in a flange that is generally parallel to the base and each base includes a central section of raised height less than the height of the legs. The central section is spaced inwardly of the ends and the sides so as to be surrounded by a band of the base. The plates are stacked in the order 1, 2, 3, 4, . . . n in alternating fashion with the flanges on the first and second plates in abutment, the flanges on the third and fourth plates in abutment . . . and the flanges on the n-1 and the nth plates in abutment, and with the bands on the second and third plates in abutment . . . and the bands on the n-2 and n-1 plates in abutment. As a consequence, first flow channels exist between the first and second plates, the third and fourth plates, . . . and the n-1 and nth plates. Second flow channels exist between the central platforms of the second and third plates . . . and the n-2 and n-1 plates. Two side plates are provided, one on each of two opposite sides of the stack. First and second ports are located in the heat exchanger at opposite ends of the plates to be in fluid communication with the first flow channel and third and fourth parts are located in one or the other or both of the side plates and are in fluid communication with the second flow channels.

In one embodiment, there are a plurality of the central sections in each of the bases of the plates and each is surrounded by a band of the base.

A highly preferred embodiment contemplates the provision of dimples in the bases with the dimples in one base abutting the dimples in the base of one adjacent plate.

One embodiment of the invention contemplates that the substantially identical plates have spaced openings aligned with one another and with respective ones of the third and fourth ports. The substantially identical plates further include cup-shaped recesses in the platforms and opening oppositely of the central platform and surrounding the openings and sealed to one another.

The plates are sealed and bonded together at the flanges and at the bands.

One embodiment of the invention contemplates that there be fins in at least some of the flow channels and abutted to adjacent plates.

In one embodiment of the invention, the height of the legs is more than twice the height of the platform whereby the first flow channels are greater in size than the second flow channels. Preferably, fins are located in the first flow channels and are bonded to adjacent plates.

Other objects and advantages will become apparent from the following specification taken in connection with the accompanying drawings.

DESCRIPTION OF THE DRAWINGS

FIG. 11 is a sectional view taken approximately along the line 11—11 in FIG. 10; and FIG. 12 is a fragmentary, sectional view taken approximately along the line 12—12 in FIG. 10.

DESCRIPTION OF THE PREFERRED EMBODIMENTS

Figure 1:
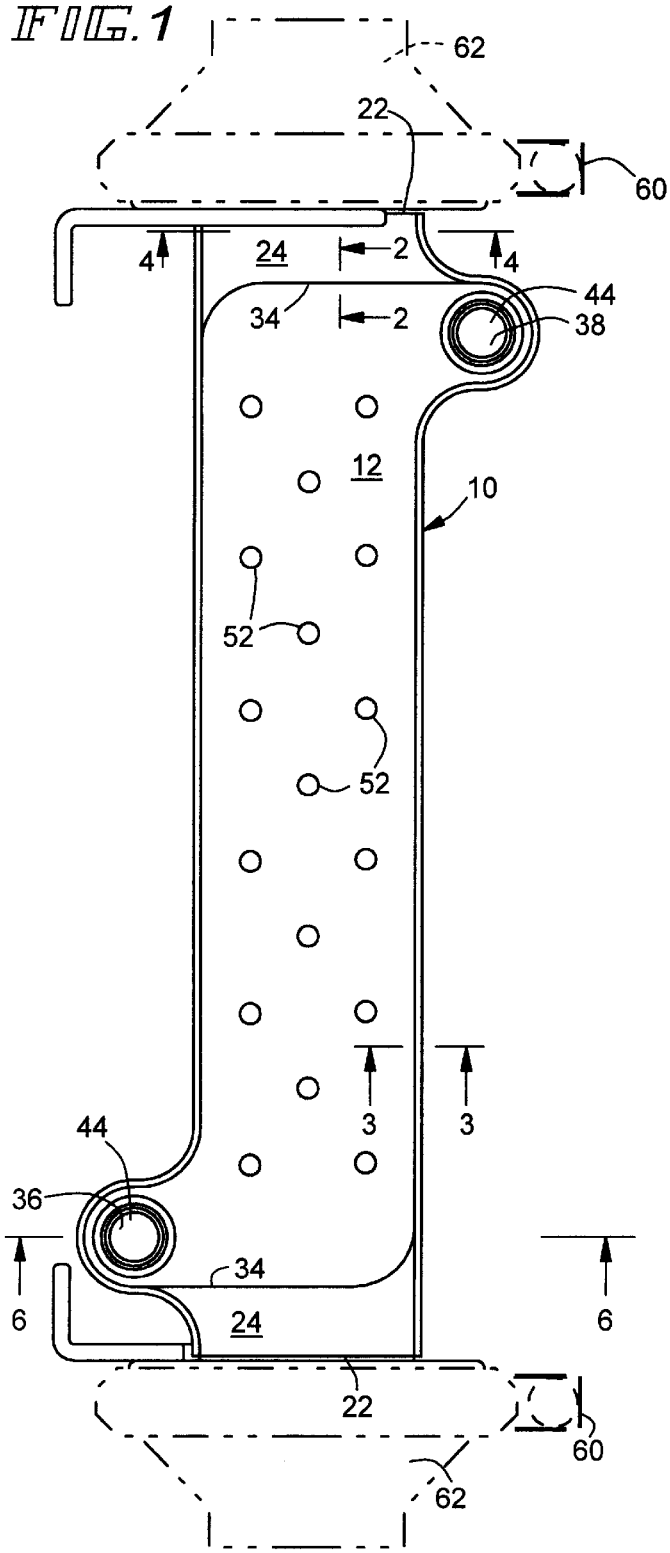
FIG. 1 is a side elevation of a heat exchanger made according to the invention with parts broken away for clarity.
Figure 5:
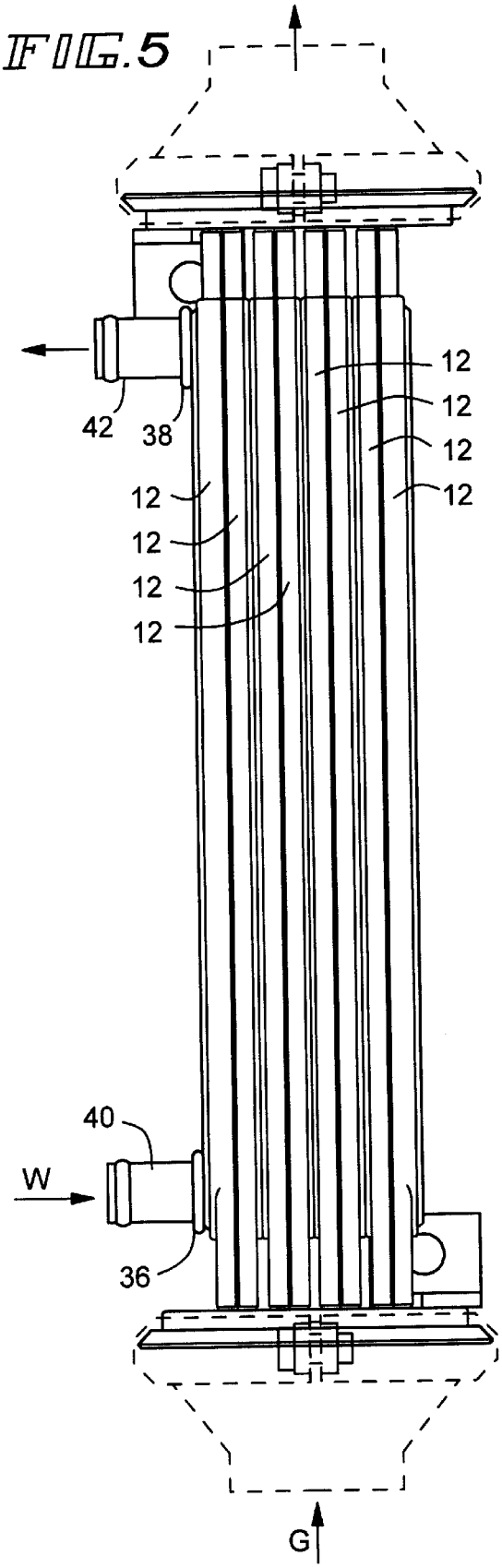
FIG. 5 is a side elevation of the heat exchanger illustrated in FIG. 1 taken at 90° to the view of FIG. 1.

A gas/liquid heat exchanger made according to the invention, and particularly suited for use as an exhaust gas heat exchanger is illustrated in the drawings. With reference to FIG. 1, it is seen to include an elongated heat exchanger core, generally designated 10, and as seen in FIG. 5, is made up of a stack of identical plates 12. While FIG. 5 shows there to be eight such plates 12, it is to be understood that any plurality of plates 12 may be utilized. For example, the heat exchanger may be made up with as few as two plates although generally, it will have four or more. The number of the plates 12 will typically be an even integer equal to "n", i.e., two, four, six, eight, etc.

Figure 4:
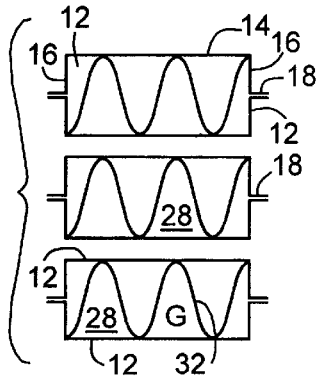
FIG. 4 is a fragmentary, sectional view taken approximately along the line 4—4 in FIG. 1.

As seen in FIG. 4, each of the plates 12 is generally in the form of an elongated channel having a base 14 flanked by side legs 16. Each of the side legs 16 terminates in an outwardly directed flange 18 which is generally parallel to the base 14.

The base 14 of each of the channel-shaped plates 12 is provided with a platform 20 located between the legs 16 on the sides of each channel and intermediate the ends 22 of the associated plates. The platform 20, in the embodiment illustrated in FIG. 1, are spaced from the legs 16 by a band 24 of the base 14 and the arrangement is further such that in the usual embodiment, the height of each platform 20 relative to the surrounding band 24 is substantially less than half the height of the legs 16. In all cases, the height of the platform 20 will be less than the height of the legs 16.

Figure 3:
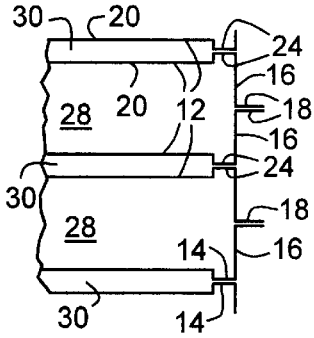
FIG. 3 is a fragmentary, sectional view taken approximately along the line 3—3 in FIG. 1.

As best seen in FIG. 3, the plates 12 are stacked in alternating fashion such that bands 24 of adjacent plates 12 are in contact with each other as are the flanges 18. By alternating fashion, it is meant that the bases 14 of two adjacent plates 12 face each other to define first flow passages 28 while the platforms 20 also face each other to form second flow passages 30. As somewhat schematically shown in FIG. 4, the flow passages 28 may be provided with undulating inserts 32 which contact and are bonded to, as by brazing, the bases 14 of adjacent plates.

More specifically, the flanges 18 of the first and second plates are in abutment as are the flanges on the third and fourth plates all the way up through the flanges on the n-1 and nth plates. At the same time, the bands 24 on the second and third plates are in abutment, and, if more than four plates are employed, the bands on the fourth and the fifth plates are in abutment up to the point where the bands on the n-2 and n-1 plates are also in abutment. Typically, the flanges 18 are sealed together as are the bands 14 as, for example, by a brazing assembly process. Consequently, each pair of the plates will define one of the first flow passages 28 and one of the second flow passages 30.

Figure 6:
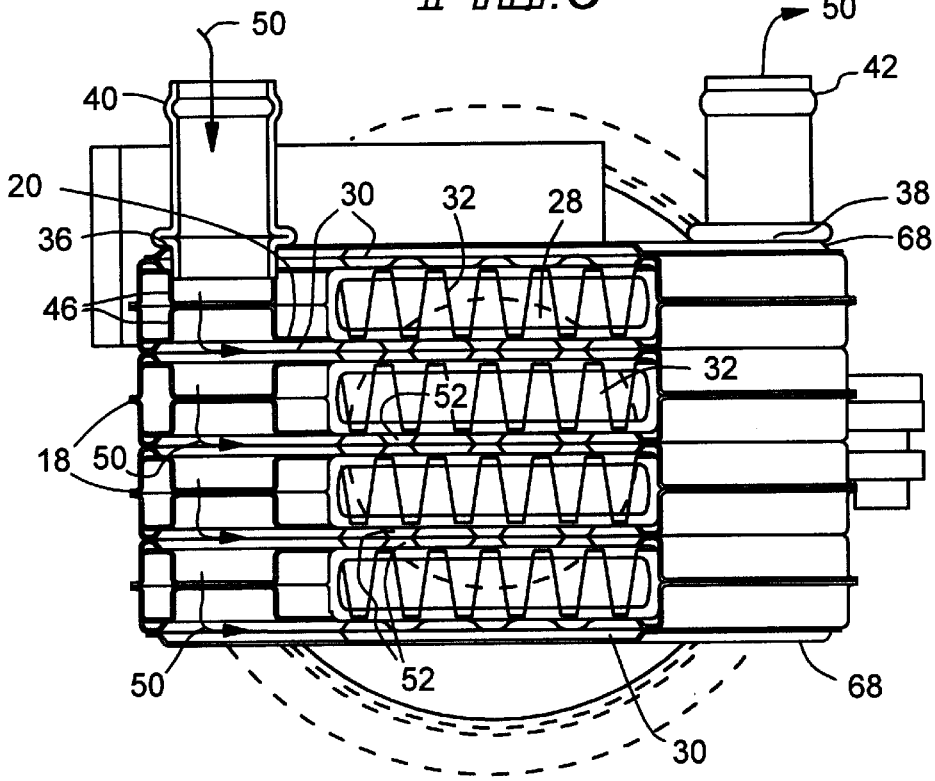
FIG. 6 is a sectional view taken approximately along the line 6—6 in FIG. 1.

As illustrated in the drawings, the flow passages 30 are considerably narrower than the flow passages 28 and are suited for receipt of a cooling liquid. The larger cross-section of the flow passages 28 make them suitable for receipt of a gas such as charge air or exhaust gas. Adjacent opposite ends 24 of the plates 12, each of the platforms 20 include an edge 34 with the two edges 34 extending in opposite directions. That is, for the vertical orientation of the core 10 shown in FIG. 1, the lower bend 34 extends to the left while the upper bend 34 extends to the right to maintain identity of the plates 12. The bends 34 extend to respective inlet and outlet ports 36, 38 which, as seen in FIGS. 5 and 6, include hose receiving nipples 40 and 42 respectively. At this location, each of the plates 12 includes an aperture 44 in the platform with the apertures 44 and each of the plates 12 being aligned with one another and being aligned with the port 36. In addition, each of the apertures 44 is located in a cup-shaped stamping 46 that extends from the surface of the platform 20 a distance sufficient to be in the same plane as the corresponding flanges 18. Thus, the bottoms of the cup-shaped recesses will be in contact with one another and may be sealed to one another during the assembly process, as by brazing. At the same time, a conduit for the ingress and exit of the coolant to and from the second flow paths 30 is provided by this structure. Flow is generally indicated by arrows 50 in FIG. 6.

In many cases it is desirable that strengthening for the flow passages 30 be provided. This can be accomplished by using a symmetrical pattern of dimples 52 in each of the plates, which dimples are located in the platforms 20 on the bases 14 and extend oppositely of the cup-shaped formations 46. As seen in FIG. 6, the dimples 52 align with and abut one another and may be bonded to one another during the assembly process, as by brazing.

Figure 2:
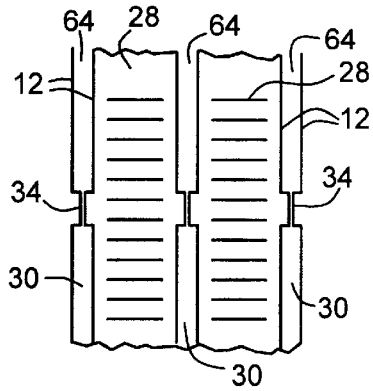
FIG. 2 is a fragmentary sectional view taken approximately along the line 2—2- in FIG. 1.

As can be seen in FIG. 2, the plates 12 define the flow passages 28, both above and below the opposite bends 34 with platforms 20. A suitable fixture 60 is then secured to the ends 22 of the plates 12 to be connected, as by a hose clamp to conduit 62. The conduit 62 conveys the gas with which heat is to be exchanged to and from the first flow passages 28. It will be observed from FIG. 2 that at locations above the bends 34 in the case of the upper part of the core 10 as viewed in FIG. 1, dead spaces 64 exist at the locations that formerly defined the second flow passages 30 but for the presence of the bends 34.

Figure 7:
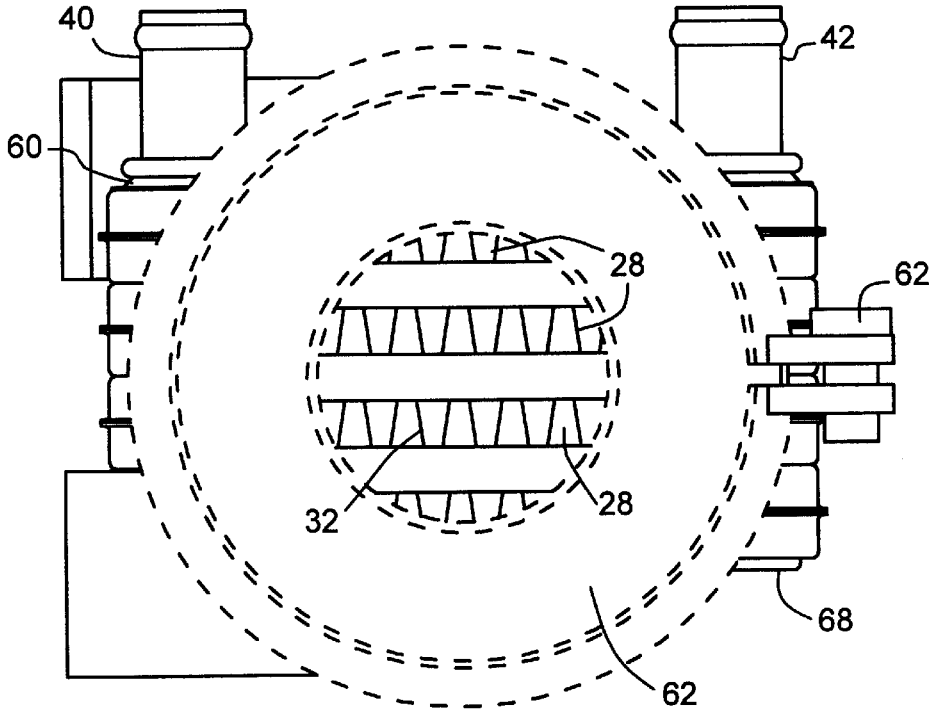
FIG. 7 is a plan view of the heat exchanger shown in FIG. 1.

With reference to FIGS. 5, 6 and 7, on each side of the stack of the plates 12 there is located an end plate 68. The end plates 68 serve as boundaries to coolant flow in the second flow passages 30 on opposite sides of the stack of the plates 12. The end plates 68 are preferably identical with one another but will not be identical to the plates 12.

Figure 8:
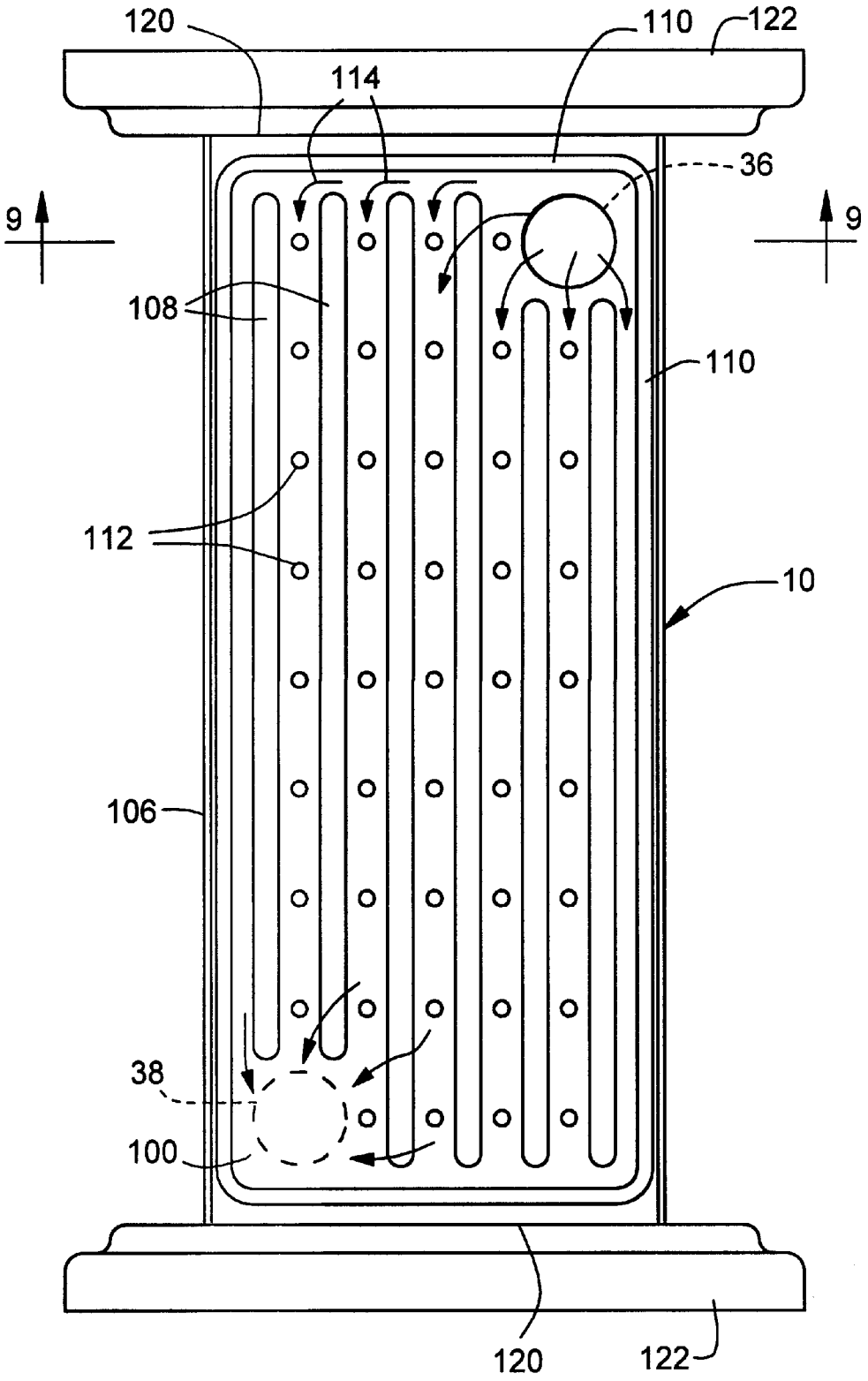
FIG. 8 is a view similar to FIG. 1 but of a modified embodiment of the heat exchanger.
Figure 9:
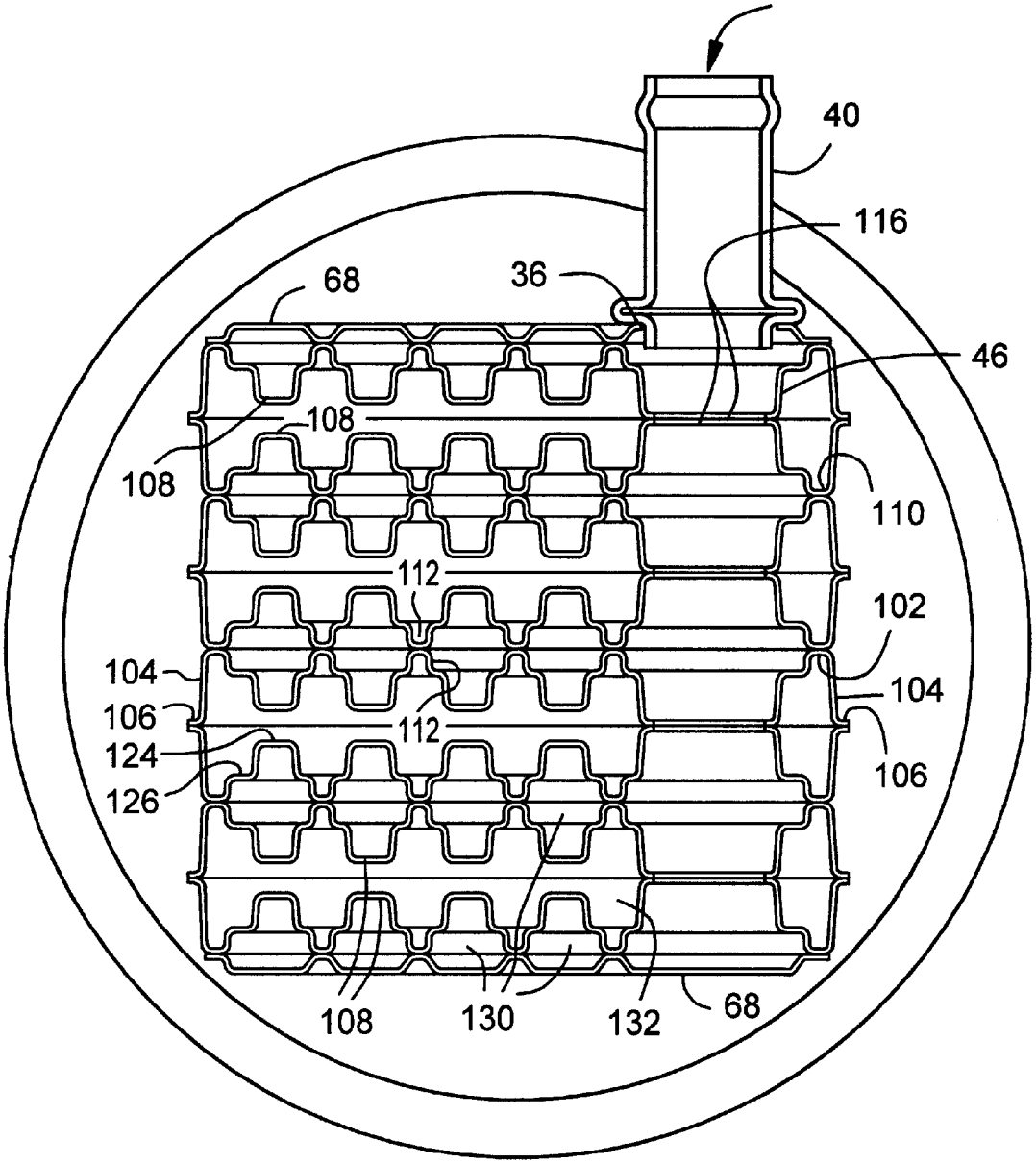
FIG. 9 is a sectional view taken approximately along the line 9—9 in FIG. 8.

A modified embodiment is illustrated in FIGS. 8 and 9. Where like components are employed, like reference numerals will be utilized. A core 10 is formed of a stack of identical plates 100 of generally rectangular configuration. The plates 100 are again channel-shaped as best seen in FIG. 9 and include a base 102 provided with legs 104 extending down opposite sides thereof. The legs 104 again terminate in flanges 106 which abut one another in the same sequence mentioned previously. In the case of the embodiment illustrated in FIGS. 8 and 9, each base 102 is provided with a plurality of platforms 108, in the illustrated embodiment, six in number. The platforms 108, in turn, are surrounded by a band 110 of the base and the bands 108 of certain of the plates 100 are in abutment in the same sequence mentioned previously.

Disposed between adjacent ones of the platforms 106 is a symmetrical pattern of dimples 112 which, as seen in FIG. 9, extend oppositely from the associated plate of the platforms 106 thereon to be in abutment with dimples 112 on adjacent plates. Diagonally opposite inlet and outlet ports 36, 38 are included and fluid flow is in the direction of arrows 114.

Each of the plates 100 includes an opening 116 with the openings 116 and the plates being aligned with one another and with appropriate one of the inlet 36 or outlet 38. The openings are surrounded by cup-shaped elements 36 corresponding to those previously described whose bottoms abut one another and are sealed to one another.

Hose connectors 40, 42 (only the former is shown) are also provided as are end plates 68.

The plate ends 120, at locations exterior of the band 110 of the base 102 receive fixtures 122 for connection to the gas circuit whose gas is to exchange heat coolant flowed into the inlet 36 and out of the outlet 38.

In this embodiment, it will be appreciated that the platforms 108 may be stepped as shown at 124, 126 to induce turbulence and thereby avoid the need of the undulating inserts 32. As with the first embodiment, coolant flow paths are defined by the space between adjacent platforms and shown at 130 in FIG. 9. These constitute the second coolant flow paths. And again, as in the case of the first embodiment, the first coolant flow path is defined by spaces 132 between the bases 102 of adjacent ones of the plates 100.

Figure 10:
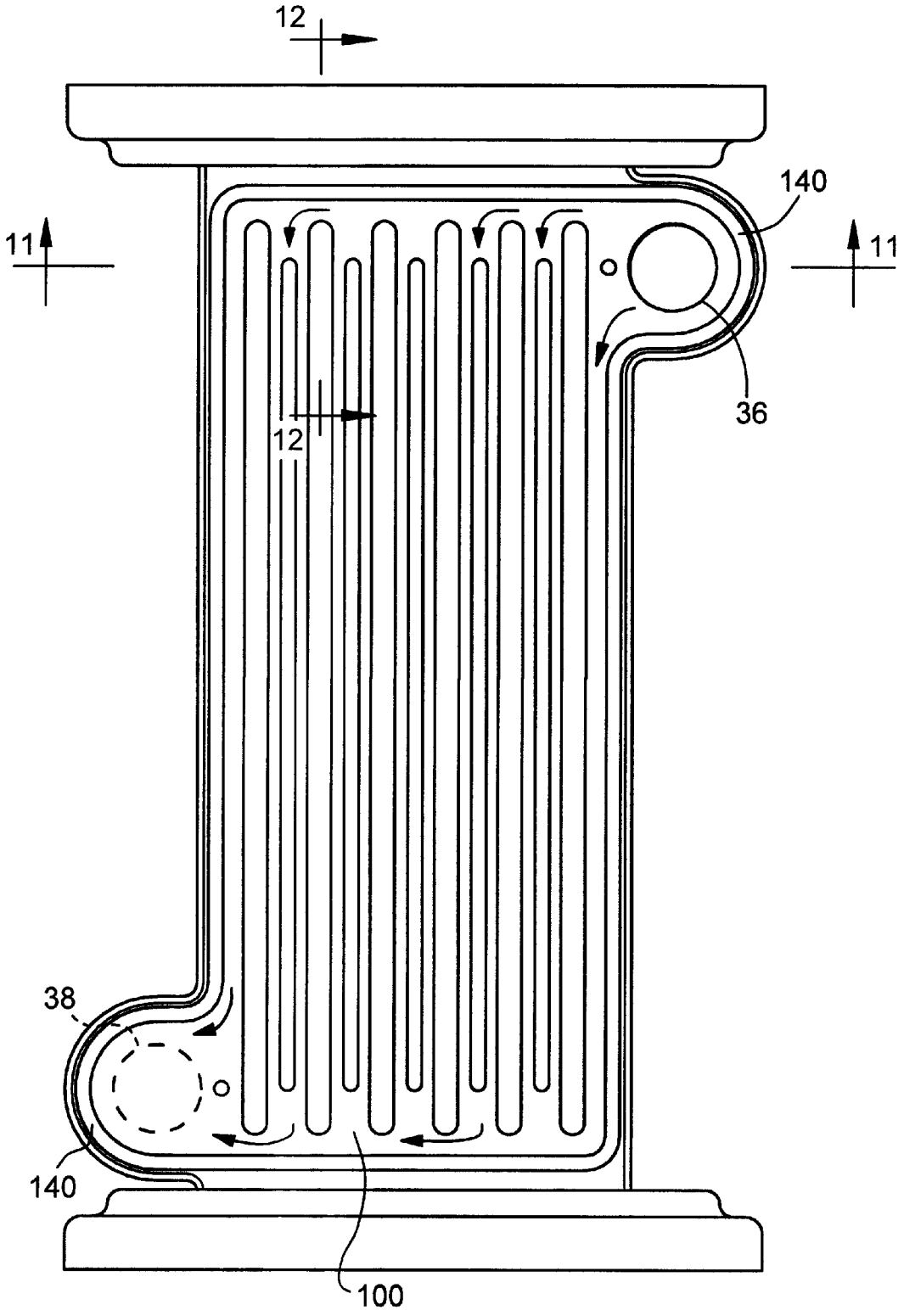
FIG. 10 is a side elevation of still another modified embodiment of the heat exchanger.

A third embodiment is illustrated in FIGS. 10–12, inclusive, and combines features of both the embodiments heretofore described. Again, identical reference numerals will be utilized for identical components.

It will immediately be recognized that the embodiment of FIGS. 10–12 is quite similar to the embodiment illustrated in FIGS. 8 and 9. In this case, however, in order to avoid any restriction on the flow of gas posed by the presence of the cup-shaped elements 46, the plates 100 have extensions 140 to each side of the basic rectangular configuration of the plates 100. That is, the ports 36, 38 to the second coolant flow passages 130 are located out of rectangular envelope in the extensions 140.

From the foregoing, it will be appreciated that three embodiments of the invention have been described which provide substantial advantages over the prior art. For example, no housing for the heat exchanger core is required, the housing being formed out of the core or heat exchanger plates themselves together with end plates. Moreover, all of the heat exchanger plates may be identical to one another minimizing the number of separate parts required. Similarly, the end plates may be of identical construction to again minimize the number of different parts required. In fact, only four different parts are required, namely, heat exchanger plates, end plates, hose nipples and inserts if used. At the same time, capacity of a given heat exchanger may be greatly increased or considerably reduced simply by selecting the appropriate number of heat exchanger plates to be employed.

The plates may be formed of aluminum and brazed together to achieve the seals between the flanges and the seals between the bands of the bases of each of the channel-shaped plates as well as the cup-shaped recesses. The plates are readily formed of aluminum sheet by conventional stamping or other forming processes.

We claim:

1. A gas/liquid heat exchanger comprising:

a stack of abutting, substantially identical plates with there being first, second, third, fourth, . . . nth plates where "n" is an even integer of four or more;

each plate being generally channel-shaped having a base with spaced sides and spaced ends extending between said spaced sides, upstanding legs on said base, each leg extending along a corresponding side and being of equal height, each leg terminating in a flange that is generally parallel to said base, each base including a central platform of raised height less than the height of said legs and spaced inwardly of said ends and said sides so as to be surrounded by a band of said base;

said plates being stacked in the order 1, 2, 3, 4, . . . n in alternating fashion with the flanges on the first and second plates in abutment, the flanges on the third and fourth plates in abutment . . . and the flanges on the n-1 and the nth plate in abutment, and with the bands on said second and third plates in abutment . . . and the bands on the n-2 and n-1 plates in abutment;

whereby first flow channels exist between said first and second plates, said third and fourth plates . . . and said n-1 and nth plates, and second flow channels exist between the central platform of said second and third plates . . . and said n-2 and said n-1 plates;

two side plates, one on each of two opposite sides of said stack;

first and second ports in said heat exchanger at opposite ends of said plates to be in fluid communication with said first flow channels; and third and fourth ports in one or the other or both of said side plates and in fluid communication with said second flow channels.

2. The heat exchanger of claim 1 wherein there are a plurality of said central platforms in each said base, each surrounded by a band of said base.

3. The heat exchanger of claim 1 further including spaced dimples in said bases, the dimples in one base abutting the dimples in the base of one adjacent plate and an end plate at each end of said stack and sealed thereagainst.

4. The heat exchanger of claim 1 wherein:

said substantially identical plates have spaced openings in said central platforms aligned with one another and with respective ones of said third and fourth ports;

said substantially identical plates further include cup-shaped recesses surrounding said openings in said central platforms, with each said cup-shaped recesses extending from the central platform of the respective substantially identical plate from which each said cup-shaped recess extends toward the flange of the respective substantially identical plate from which each said cup-shaped recess extends; and said cup-shaped recesses are sealed to one another.

5. The heat exchanger of claim 1 wherein said plates are sealed and bonded together at said flanges and said bands.

6. The heat exchanger of claim 1 further including fins in at least some of said flow channels and bonded to adjacent plates.

7. The heat exchanger of claim 1 wherein the height of said legs is more than twice the height of said platform, whereby said first flow channels are greater in size than said second flow channels.

8. The heat exchanger of claim 7 further including fins in said first flow channels and bonded to adjacent plates.

* * * * *